US005189285A

United States Patent [19]

Young, Jr.

[11] Patent Number: 5,189,285

[45] Date of Patent: Feb. 23, 1993

[54] CALENDAR DATE FINDER

[76] Inventor: Fletcher D. Young, Jr., 20882 Greenview, Southfield, Mich. 48075

[21] Appl. No.: 809,911

[22] Filed: Dec. 18, 1991

Related U.S. Application Data

[63] Continuation-in-part of Ser. No. 596,528, Oct. 12, 1990, abandoned.

[51] Int. Cl.[5] ..... G06C 3/00

[52] U.S. Cl. ..... 235/88 R; 235/78 R

[58] Field of Search ..... 235/88 R, 77, 78 R

[56] References Cited

U.S. PATENT DOCUMENTS 2,932,104 4/1960 Corbett ..... 235/88 R 4,329,570 5/1982 Koll ..... 235/88 R

*Primary Examiner*—Michael L. Gellner

*Assistant Examiner*—Eddie C. Lee

*Attorney, Agent, or Firm*—Peter D. Keefe

[57] ABSTRACT

A calendar date finder in the form of a circular slide rule composed of two interacting disks, rotation of one disk relative to the other selectively providing calendar date information from a first preselected year through a second preselected year, inclusive. An upper disk has a circular periphery with a notch along a portion thereof, and further has a cut-out spaced uniformly from the periphery and extending along a portion of the periphery. Numeric indicia are printed on the upper disk adjacent the notch. The numeric indicia are sequential numbers from 1 to 31 representing the thirty-one days of a calendar month. Month indicia are printed on the upper disk in a predetermined pattern adjacent the cut-out. A lower disk has week day indicia printed thereon uniformly spaced along the periphery thereof, in a sequential pattern. Spaced inwardly from the week day indicia is a predetermined pattern of year indicia indicating each year from the first through the second preselected years, inclusive. The position of the year indicia is such as to show through the cut-out, and the position of the week day indicia is such as to show through the notch. Alignment of a month indicia with a year indicia automatically indicates the days of the week for dates in that month in that year.

6 Claims, 2 Drawing Sheets

CALENDAR DATE FINDER

CROSS-REFERENCE TO RELATED APPLICATIONS

The present application is a continuation-in-part application of co-pending application Ser. No. 07/596,528, filed on Oct. 12, 1990, now abandoned.

BACKGROUND OF THE INVENTION

1. Field of the Invention

The present invention relates to slide rule devices, and more particularly to a slide rule device for finding particular calendar dates within a predetermined range of years. Still more particularly, the present invention relates to a slide rule for finding particular calendar dates and particular calendar months within a predetermined range of years.

2. Description of the Prior Art

Calendars provide indispensable information. Social and business events are usually planned with great care well in advance, and without reference to a calendar, the planner would be lost to select a date for an event with confidence. And, in today's very complicated social and business climate, such dates must be planned often years in advance.

Unfortunately, calendars ordinarily span but a single year. Those calendars which show multiple years, generally do so by printing three or four whole year calendars side-by-side, as is frequently the case with checkbook recording forms that are issued by bands. Therefore, it would be very useful if a date could be ascertained over a span of many years.

Some attempts along these lines have been attempted in the prior art. For instance, there are algorithms that can generate calendar date data utilizing a computer. There is a wide range of calendars on the market, including a perpetual calendar that displays the month, day and date by the turn of a dial; however, it does not have the year included in its design. The "Perpetual Calendar" is available through Spencer Gifts catalog. Also, double disk models my be imprinted with information, such as complete NFL football schedules for a particular year. A team would be lined up with a specific date, and the individual could view the opposing team scheduled to play that day; it also tells the individual whether the game is home or away and the estimated starting time of the game. While these and other similar calendars exist, they do not offer a twenty-seven year span of dates.

Accordingly, what is needed is a simple to use slide rule type calendar date finder that spans many years.

SUMMARY OF THE INVENTION

The present invention is a calendar date finder in the form of a circular slide rule composed of two interacting disks. Rotation of one disk relative to the other selectively providing calendar date information from a first preselected year through a second preselected year, inclusive.

An upper disk and a lower disk are mutually rotatably connected together at the respective center of each. The upper disk has a circular periphery with a notch along a portion thereof. The upper disk further has a cut-out spaced uniformly from the periphery and extending along a portion of the periphery. Numeric indicia are printed on the upper disk adjacent the notch. The numeric indicia are sequential numbers from 1 to 31 representing the thirty-one days of a calendar month, arranged in a conventional pattern of seven columns, each representing a calendar week. Month indicia are printed on the upper disk in a predetermined pattern adjacent the cut-out. The lower disk has week day indicia printed thereon uniformly spaced along the periphery thereof, in a sequential pattern repeated four times. Spaced inwardly from the week day indicia is a predetermined pattern of year indicia indicating each year from a first preselected year through a second preselected year, inclusive. The position of the year indicia is such as to show through the cut-out, and the position of the week day indicia is such as to show through the notch.

In operation, when a user wishes to obtain date information with respect to a certain month in a certain year, the user simply aligns the respective month indicia with the relative year indicia. Automatically, the numeric indicia will be correctly aligned with respect to the week day indicia for the selected month in the selected year. The day of any date in that month will now be clear to the user.

Accordingly, it is an object of the present invention to provide a calendar date finding slide rule which can provide calendar date information for any year between preselected first and second years, inclusive.

It is another object of the present invention to provide a calendar date finding slide rule which can provide calendar date information for any year between preselected first and second years, inclusive, the slide rule being composed of two disks which are rotated relative to one another so as to align indicia printed thereon.

It is a further object of the present invention to provide a calendar date finding slide rule which can provide calendar date information for any year between preselected first and second years, inclusive, a whole month of calendar date information being provided simultaneously.

DETAILED DESCRIPTION OF THE PREFERRED EMBODIMENT

Figure 3:
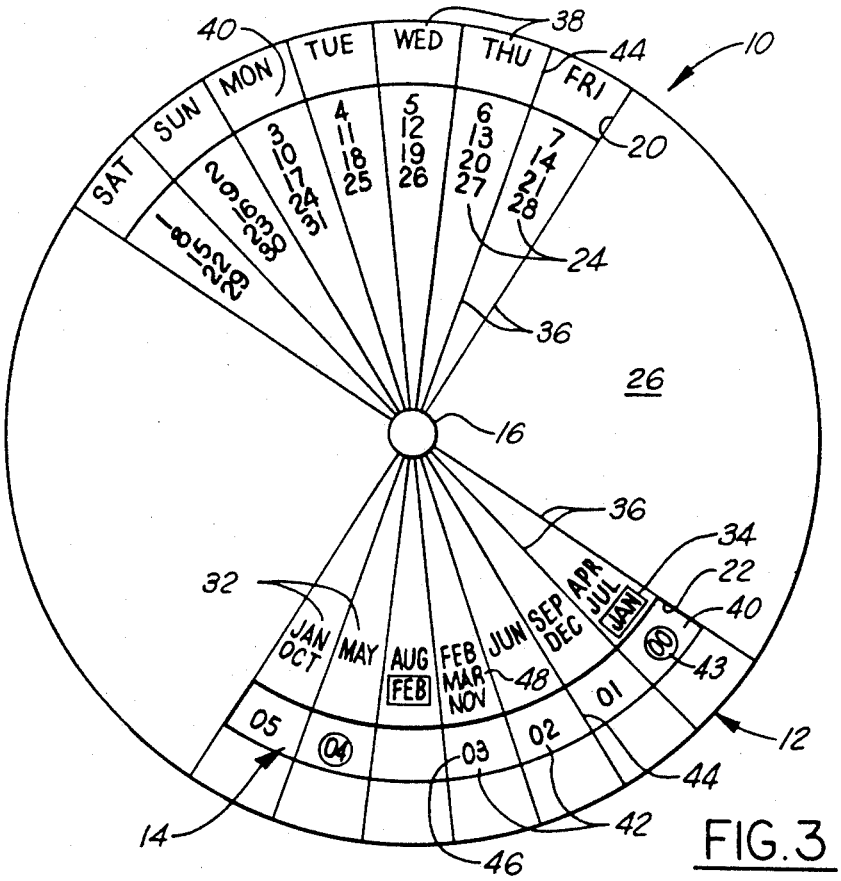
FIG. 3 is a top plan view of the present invention, showing the upper and lower disks in a first position of operation.
Figure 4:
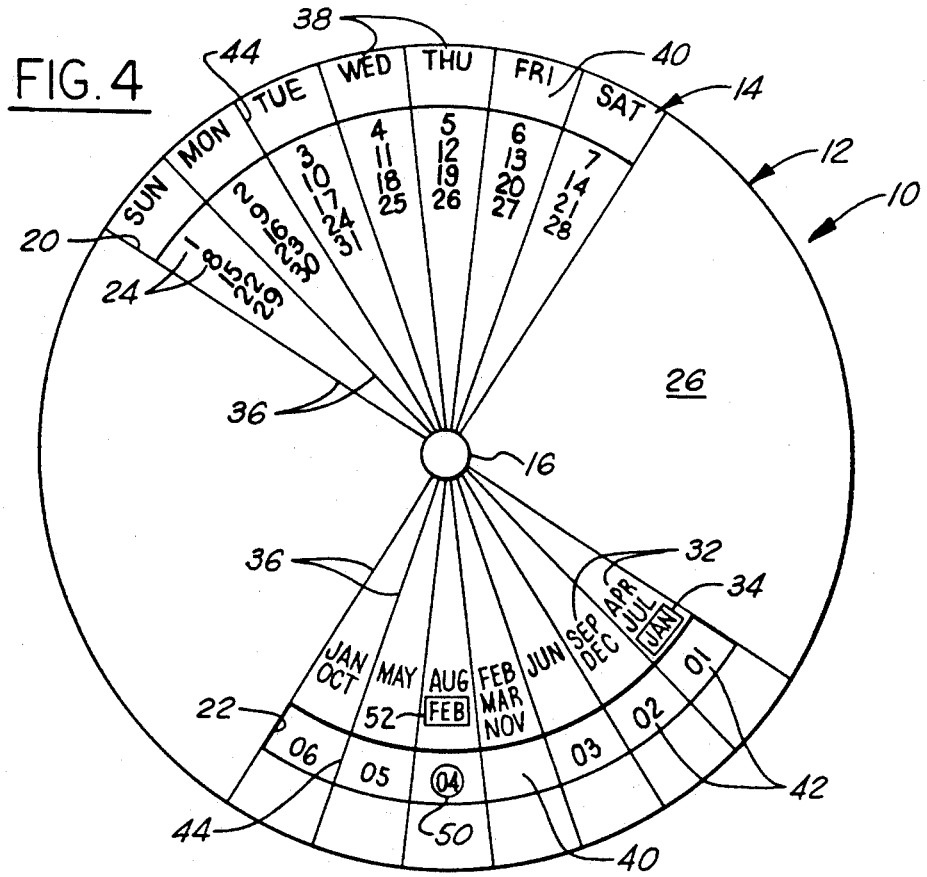
FIG. 4 is a top plan view of the present invention, showing the upper and lower disks in a second position of operation.
Figure 5:
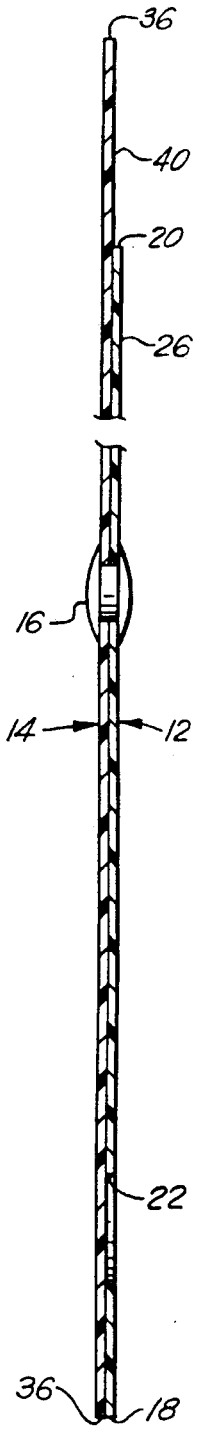
FIG. 5 is a sectional side view of the present invention.

Referring now to the Drawing, FIGS. 3, 4 and 5 show the date finder 10 according to the present invention in operation. It will be seen from these figures that the date finder 10 is composed of two major components: an upper disk 12 and a lower disk 14. Each of the upper and lower disks is circular in shape and they are mutually joined at the center thereof by a rivet 16 or other conventional fastening device which permits relative rotation between the upper and lower disks.

Figure 1:
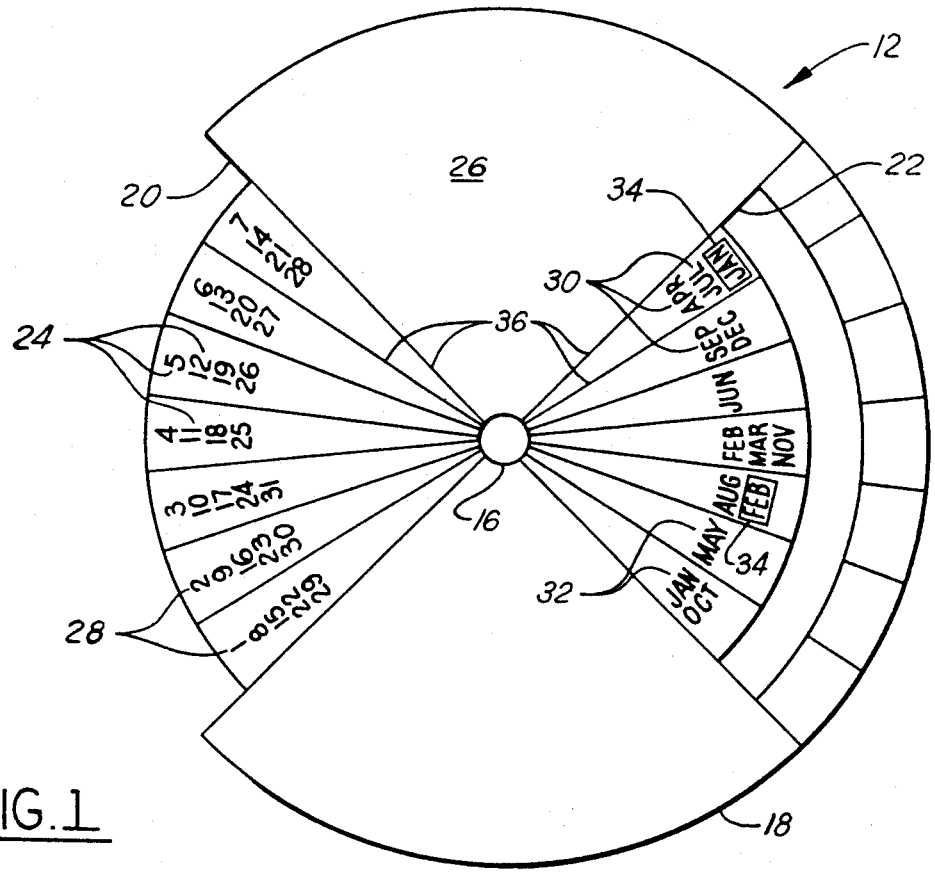
FIG. 1 is a top plan view of the upper disk according to the present invention.
Figure 2:
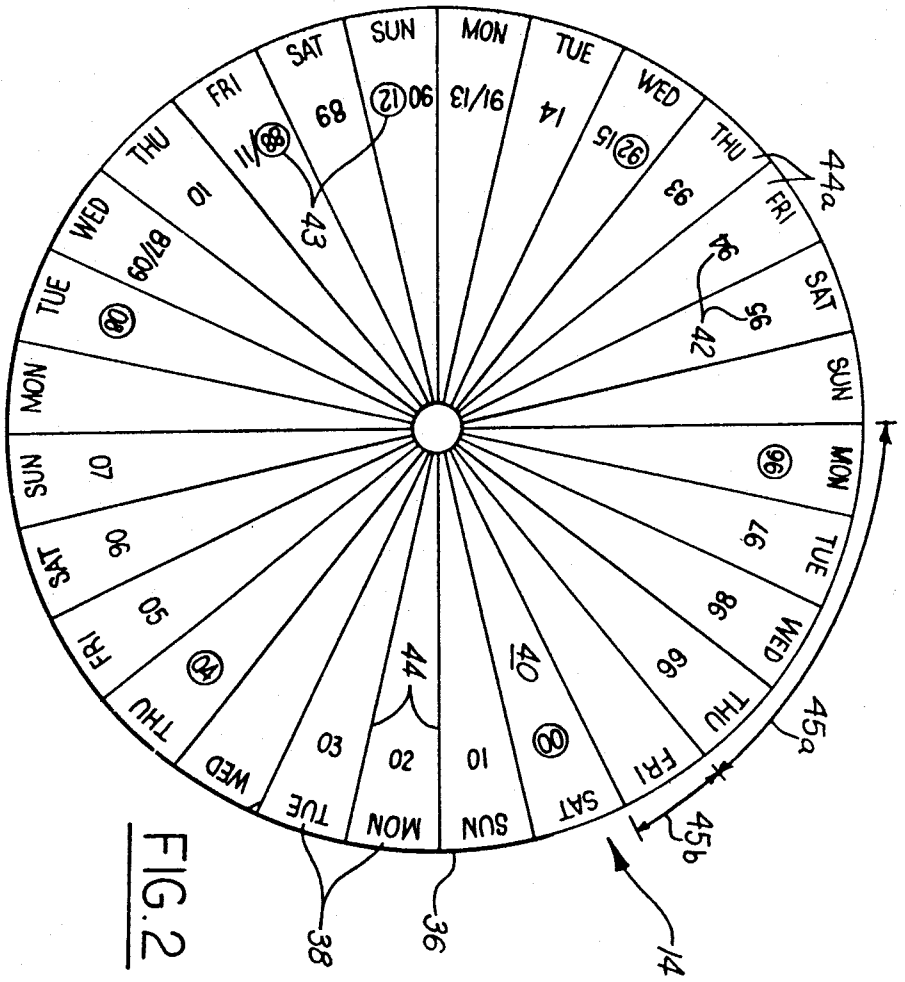
FIG. 2 is a top plan view of the lower disk according to the present invention.

The structure of the upper and lower disks will now be detailed utilizing in particular FIGS. 1, 2 and 3.

FIG. 1 depicts the upper disk 12. The upper disk is of circular shape, defined by a periphery 18. Along a portion of the periphery is located a notch 20. The length and width of the notch is predetermined in a manner that cooperates with the lower disk 14, as will be explained fully hereinbelow. Located near the periphery 18 at a position opposite that of the notch 20 is a cut-out 22. The cut-out 22 is everywhere spaced uniformly from the periphery 18, this spacing, the length of the cut-out and the width of the cut-out are predetermined in a manner that cooperates with the lower disk 14, as will be explained in detail hereinbelow. Adjacent the notch 20 is a numeric indicia 24 placed upon the upper surface 26 of the upper disk 12. The numeric indicia are sequential numbers from 1 to 31 representing the maximum number of thirty-one days of a calendar month, arranged in a sequentially conventional pattern of seven columns 28, each representing a calendar week. Month indicia 30 are placed upon the upper surface 26 of the upper disk 12 in a predetermined pattern adjacent the cut-out 22, between the cut-out and the rivet 16. The purpose of the sequence of the month indicia 30 will become clear when operation of the date finder 10 is described hereinbelow. Suffice for now that the pattern is in the form of seven sequential columns 32 of month indicia representing the names of the months, as follows: first column: January, October; second column: May; third column: August and February; fourth column: February, March and November; fifth column: June; sixth column: September and December; and the seventh column: April, July and January. For operational purposes, which will become clear from the description hereinbelow, the month indicia 30 representing February in the third column and January in the seventh column is provided with an indicator marking 34, in this case a box. It is preferred to provide radial line indicia 36 radiating from the center of the upper disk, the lines serving to visually separate adjacent columns 32 of month indicia 30 and adjacent columns 28 of numeric indicia 24.

The lower disk 14 is also circular, defined by a periphery 36. Adjacent the periphery 36 is located week day indicia 38 provided on the upper surface 40 of the lower disk. The week day indicia 38 are arranged in a sequential pattern of Sunday, Monday, Tuesday, Wednesday, Thursday, Friday and Saturday, which is repeated four times. Spaced inwardly from the week day indicia 38 is a predetermined pattern of year indicia 42 that indicates each year from a first preselected year through a second preselected year, inclusive; the Drawing shows, by way of example, the years 1987 through 2015, inclusive. Some of the year indicia 42 are distinguished by a leap year indicator marking 43, in this case a circle, which distinguishes each of these years as leap years. The purpose of the sequence of the year indicia 42 will become clear when operation of the date finder 10 is described hereinbelow. It is preferred to provide radial line indicia 44 emanating from the center of the lower disk to the periphery forming wedges 44*a* which thereby provide a visual distinction between adjacent week day indicia 38 and between adjacent year indicia 42.

Other years besides those shown in the Drawing may be used according to the following formula. The year indicia 42 are arranged in groups 45*a* of four sequential years, each group being spaced apart by an empty wedge 45*b*. Of course, some years may be omitted in a group, if for some reason those years are not wanted. The first year indicia 42 of each group 45*a* is a leap year distinguished by a leap year indicator marking 43. For example, the year 1986 can be added by placing a year indicia "86" on the wedge 44*a* occupied by the year indicia for 2008, "08". Similarly, for example, the year 2016 can be added by placing a year indicia "16" on the wedge 44*a* occupied by the year indicia for 1994, "94". Since any multiple number of year indicia 42 can occupy the same wedge, as "87" and "09" are shown to do in FIG. 2, the aforesaid formula allows for any number of years to be present, over any range of years.

With reference to FIG. 5, it is seen that the upper and lower disks are each secured together at the center using a rivet 16. In so doing, the upper surface 26 of the upper disk 12 faces to the right in the figure, while the upper surface 40 of the lower disk faces also to the right in the figure. More particularly with reference to FIGS. 3 and 4, it is seen that the shape and position of the notch 20 allows seven week day indicia 38 to be seen; further the shape and position of the cut-out 22 allows year indicia 42 to be seen beneath and adjacent the month indicia 32. Thus, is established an operative interrelationship between the upper disk and the lower disk. It is preferred that the upper and lower disks 12 and 14 be constructed of a durable material, such as plastic or coated paper. It is further preferred that the upper and lower disks have the same peripheral diameter. Still further, it is preferred that the numeric indicia 24, the month indicia 30, the week day indicia 38, the year indicia 42 and the radial line indicia 36 be in the form of printing and that each of the upper and lower disks be opaque.

Operation of the date finder 10 will now be described with particular reference to FIGS. 3 and 4.

With reference first to FIG. 3, consider that a user wishes to know the week day for Mar. 26 in the year 2003, a non-leap year. The user would rotate the lower disk relative to the upper disk until the year indicia 42 representing the year of 2003 46 (in the figure this is depicted as "03") is aligned with the month indicia 32 for the month of March 48 (in the figure this is depicted as "MAR"). Immediately visible at the notch 20 are the week day indicia 38 which correctly corresponds to the numeric indicia 24 so as to indicate all dates for Mar. 2003. The user now simply looks for the numeral indicia 24 for the month day of 26, then proceeds up the column to the week day, which turns out to be Wednesday.

Notice that there are two January and February month indicia, and that those in the third and seventh columns are distinguished by an indicator marking 34 in the form of a box. Further, notice that certain of the year indicia 42 are distinguished by a leap year indicator marking 43 in the form of a circle. Distinguished year indicia must be aligned with distinguished month indicia only with respect to the months of January and February, otherwise any month indicia are alignable with any year indicia. This alignment rule will become evident from the following description of operation using distinguished indicia.

With reference secondly to FIG. 4, consider that a user wishes to know the week day for Feb. 13, 2004, a leap year. The user has chosen a year that has a distinguished leap year indicia 50 (in the figure this is depicted as "04" with a circle around it). Accordingly, this year indicia must be aligned with a distinguished month indicia when looking at the months of January or February. In this case, since the user wants February, the user rotates the upper disk relative to the lower disk so that the distinguished month indicia for the month of February 52 is aligned with the distinguished year indicia for the year of 2004 50. Immediately visible at the notch 20 are the week day indicia 38 which correctly corresponds to the numeric indicia 24 so as to indicate all dates for the month of Feb., 2004 (it being common knowledge and the responsibility of the user to know that 2004 is a leap year in which February has 29 days, meaning the user ignores numeral indicia numbers 30 and 31). The user now simply looks for the numeral indicia 24 for the month day of 13, then proceeds up the column to the week day, which turns out to be Friday. By contrast, refer again to FIG. 3 and notice that the month indicia 32 for May is also shown aligned with the year indicia 42 for 2004. Even though the year indicia for 2004 is a distinguished one, this alignment is valid, as only the months of January and February follow the rule for alignment between mutually distinguished indicia.

While 31 days are indicated by the numeric indicia 24, not all months have 31 days in them, and it is the responsibility of the user to ignore the extra numeric indicia. Accordingly, information indicia may be added to the rear side 54 of the lower disk 14 to inform the user of this situation. Such indicia may include the number of days in each month (31 days for January, March, May, July, August, October and December; 30 days for April, June, September, and November; and 28 or 29 days for February, depending on leap year rules). This indicia would assist the user to more easily ascertain a date in any year covered by the date finder. 10.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. A slide rule for finding calendar date information for any year between a first preselected year and a second preselected year, inclusive, said slide rule comprising:

a first disk having a first side and a first periphery, said first disk having a notch along a predetermined portion of said first periphery, said first disk further having a cut-out spaced a predetermined distance from said first periphery along a predetermined portion of said first periphery opposite said notch;

numeric indicia placed on said first side of said first disk at a location adjacent said notch, said numeric indicia being arranged as a sequence of numbers from 1 to 31 and being further arranged in a series of seven columns;

month indicia placed on said first side of said first disk at a location adjacent said cut-out, said month indicia being arranged in a predetermined pattern of seven columns;

a second disk having a second side and a second periphery;

week day indicia placed on said second side of said second disk at a location adjacent said second periphery, said week day indicia being arranged in a predetermined pattern along said second periphery in order of the seven days of the week, specifically Sunday, Monday, Tuesday, Wednesday, Thursday, Friday, and Saturday, repeating in four sets thereof;

year indicia placed on said second side of said second disk at a location adjacent said week day indicia, said year indicia being arranged in a predetermined pattern, said year indicia indicating every year from 1987 through 2015, inclusive; and connection means for connecting said first disk to said second disk so that said first disk may rotate with respect to said second disk, said second side of said second disk facing said first disk, said first side of said first disk facing away from said second disk one set of seven week day indicia of said week day indicia being visible through said notch in said first disk so that one week day indicia is alignable with a respective one of said columns of said numeric indicia, said year indicia being visible through said cut-out in said first disk so that any of said year indicia is alignable with a respective one of said columns of said month indicia;

wherein selective alignment of a year indicia with a month indicia automatically causes an alignment of said numeric indicia with said week day indicia so as to indicate all calendar dates in the selected month in the selected year.

2. The slide rule of claim 1, wherein said predetermined pattern of year indicia is arranged in a sequence with respect to said week day indicia comprising: Friday: 1988/2011; Saturday: 1989; Sunday: 1990/2012; Monday; 1991/2013; Tuesday: 2014; Wednesday: 1992/2015; Thursday: 1993; Friday: 1994; Saturday 1995; Sunday: none; Monday 1996; Tuesday: 1997; Wednesday: 1998; Thursday: 1999; Friday: none; Saturday: 2000; Sunday: 2001; Monday: 2002; Tuesday: 2003; Wednesday: none; Thursday: 2004; Friday: 2005; Saturday: 2006; Sunday: 2007; Monday: none; Tuesday: 2008; Wednesday: 1987/2009; and Thursday: 2010.

3. The slide rule of claim 2, wherein said predetermined pattern of month indicia is arranged in a sequence with respect to said columns comprising: first column: January/October; second column: May; third column: August/February; fourth column: February/March/November; fifth column: June; sixth column: September/December; and seventh column: April/July/January.

4. The slide rule of claim 3, further comprising first distinguishing indicia placed on said second side of said second disk adjacent preselected year indicia which are leap years; and second distinguishing indicia placed on said first side of said first disk adjacent said month indicia for January in said seventh column and for February in said third column, a year indicia having said first distinguishing indicia being aligned only with a month indicia having a second distinguishing indicia for the months of January and February in order to indicate all dates in the selected month in the selected year.

5. The slide rule of claim 4, further comprising first radial line indicia for separating adjacent said numeric indicia and for separating adjacent month indicia.

6. The slide rule of claim 5, further comprising second radial line indicia on said second side of said second disk for separating adjacent year indicia and for separating adjacent week day indicia, said first and second indicia being substantially mutually alignable at said cut-out and said notch.

* * * * *